United States Patent [19]

Nassof

[11] Patent Number: 4,773,194

[45] Date of Patent: Sep. 27, 1988

[54] GRAFFITI-RESISTANT CEILING TILE

[75] Inventor: Martin Nassof, Cliffside Park, N.J.

[73] Assignee: Simplex Ceiling Corp., Hoboken, N.J.

[21] Appl. No.: 110,221

[22] Filed: Oct. 19, 1987

[51] Int. Cl.[4] ..... E04B 5/52

[52] U.S. Cl. ..... 52/145; 52/397; 52/484; 52/762; 52/511

[58] Field of Search ..... 52/397, 144, 145, 488, 52/384, 475, 511, 762, 474, 393, 482, 484, 483, 485

[56] References Cited

U.S. PATENT DOCUMENTS

| | | | |
|---|---|---|---|
| 2,227,452 | 1/1941 | Jullien | 52/762 |
| 2,676,481 | 4/1954 | Hoffman | 52/384 |
| 2,692,547 | 10/1954 | Ericson | 52/145 |
| 3,174,590 | 3/1965 | Haker | 52/762 |
| 3,228,163 | 1/1966 | Lindstrom | 52/762 |
| 3,469,866 | 9/1969 | Ashby | 52/511 |
| 3,828,506 | 8/1974 | Phillips | 52/488 |
| 4,648,229 | 3/1987 | Limp | 52/484 |
| 4,696,142 | 9/1987 | Mieyal | 52/762 |

FOREIGN PATENT DOCUMENTS

| | | | |
|---|---|---|---|
| 190094 | 10/1963 | Sweden | 52/762 |

OTHER PUBLICATIONS

"Wash-Alume II", Simplex Ceiling Corp.

"Simplex" Catalogue, Simplex Ceiling Corp. (1979).

*Primary Examiner*—John E. Murtagh

*Attorney, Agent, or Firm*—Jacobs & Jacobs

[57] ABSTRACT

A suspended ceiling suspended from the structural ceiling of a room, which comprises a plurality of parallel, elongated, snap-bars, each having a pair of longitudinally extending, opposed spring-like arms biased to be closely together, and a plurality of metal ceiling tiles held by snap bars in side-by-side relationship, each said ceiling tile having a planar metal body having opposed sides, opposed ends, top and bottom faces and 90° corners, a pair of spaced tabs at each side projecting from said top face, and a layer of vitreous material on said bottom surface, the tabs of one side of one ceiling tile being held within the same snap-bar as the tabs of the immediately adjacent side of the next adjacent ceiling tile.

13 Claims, 4 Drawing Sheets

GRAFFITI-RESISTANT CEILING TILE

The present invention relates to a suspended ceiling system based on the use of a grid of snap bars that support ceiling tiles having an exposed vitreous layer on the bottom surface and to the ceiling tiles themselves.

Suspended ceiling systems are known in which metal ceiling panels are supported by parallel snap bars that are in turn suspended from the structural ceiling of the room. In this prior art suspended ceiling, flanges extending along the entire opposed sides of the ceiling panels are snapped into the snap bars, leaving the bottom surfaces of the metal panels exposed.

A conventional metal ceiling panel has flanges extending along all four sides thereof, as shown for example in my U.S. Pat. No. 4,549,375. In the present invention, small tabs are provided on opposed sides of the ceiling panel for insertion into the snap-bars, which provides several advantages. Thus, conventional snap bars are designed to receive and hold relatively light gauge metal, such as 20 gauge or thinner. By using small tabs in accordance with the present invention, instead of the full length side flanges of the prior art, the panels can be made of heavier gauge metal, say up to 14 gauge, and yet be received and held by the conventional snap bars. Heavier gauge metal panels are useful when a vandal-resistant ceiling is desired. Heavier gauge metal panels are particularly useful when a graffiti-resistant vitreous coating is carried on the exposed bottom surface of the panels, since heavier gauge metal panels can be porcelainized without warping.

In particular, the present invention provides a suspended ceiling system for a room, which comprises a plurality of parallel snap bars suspended from the structural ceiling of the room and extending across the room, each snap bar having opposed spring-like arms biased together, and a plurality of ceiling tile assemblies are held in the snap-bars, side-by-side, each assembly comprising a ceiling tile having a planar bottom face, preferably carrying a layer of a vitreous material, the tile having tabs at opposed sides thereof extending into the snap bar to hold the ceiling tile assmblies in place. Preferably, a gasket in the form of an open frame surrounds the perimeter of the tile, the bottom face of the tile being visible through the opening in the gasket, and the tabs extend through the gasket and into the snap bars.

The flexible and resilient gasket protects the vitreous coating from chipping that could otherwise occur when two coated tiles are snapped into the snap bar side-by-side. In addition, when the gaskets of adjacent tiles are in contact with each other, a water- and vapor-tight seal is provided, thereby preventing the suspension hangers above the metal tile from rusting. The moisture barrier created by the network of contacting gaskets of the ceiling tile assemblies is particularly desirable in interior areas where moisture-laden air is encountered, such as swimming pools. In the past, suspended ceilings over swimming pools have collapsed due to corrosion and rusting of the suspension hangers caused by moisture penetration through conventional ceilings.

The present invention is illustrated in terms of its preferred embodiments in the accompanying drawings, in which FIG. 1 is a view in perspective of a suspended ceiling according to the invention;

Figure 1:
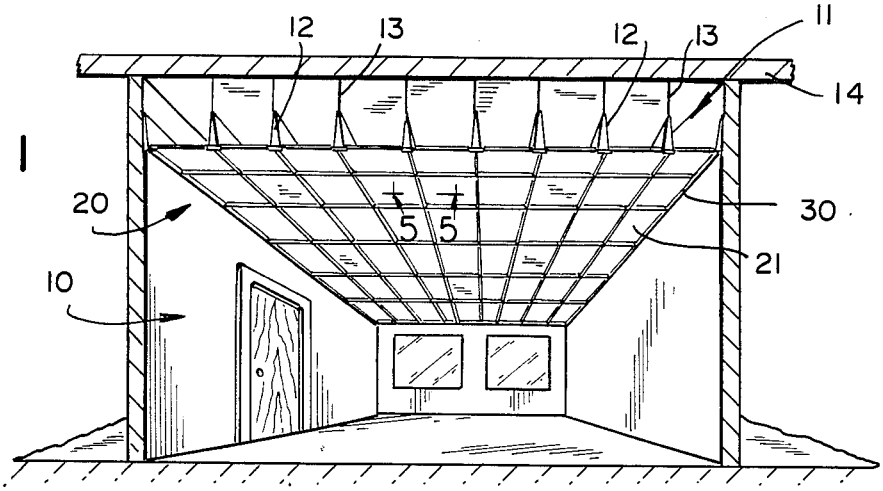

With reference to FIG. 1, room 10 is provided with a suspended ceiling 11 that extends substantially from wall-to-wall and end-to-end of the room. The suspended ceiling 11 is provided with concealed, conventional snap bars 12 that run longitudinally across the room, which are themselves carried by wires 13 or other conventional hangers that are hung from the structural ceiling 14, all in a manner known per se. Metal ceiling tile assemblies 20 are supported by the snap bars 12 in a manner described below. Ceiling tile assemblies 20 comprise a metal ceiling tile 21 and a flexible gasket 30 about the perimeter of tile 21. Tile 21 has a layer 22 (FIG. 5) of a vitreous material on its bottom surface so that the vitreous material 22 is exposed when viewed from below.

Figure 2:
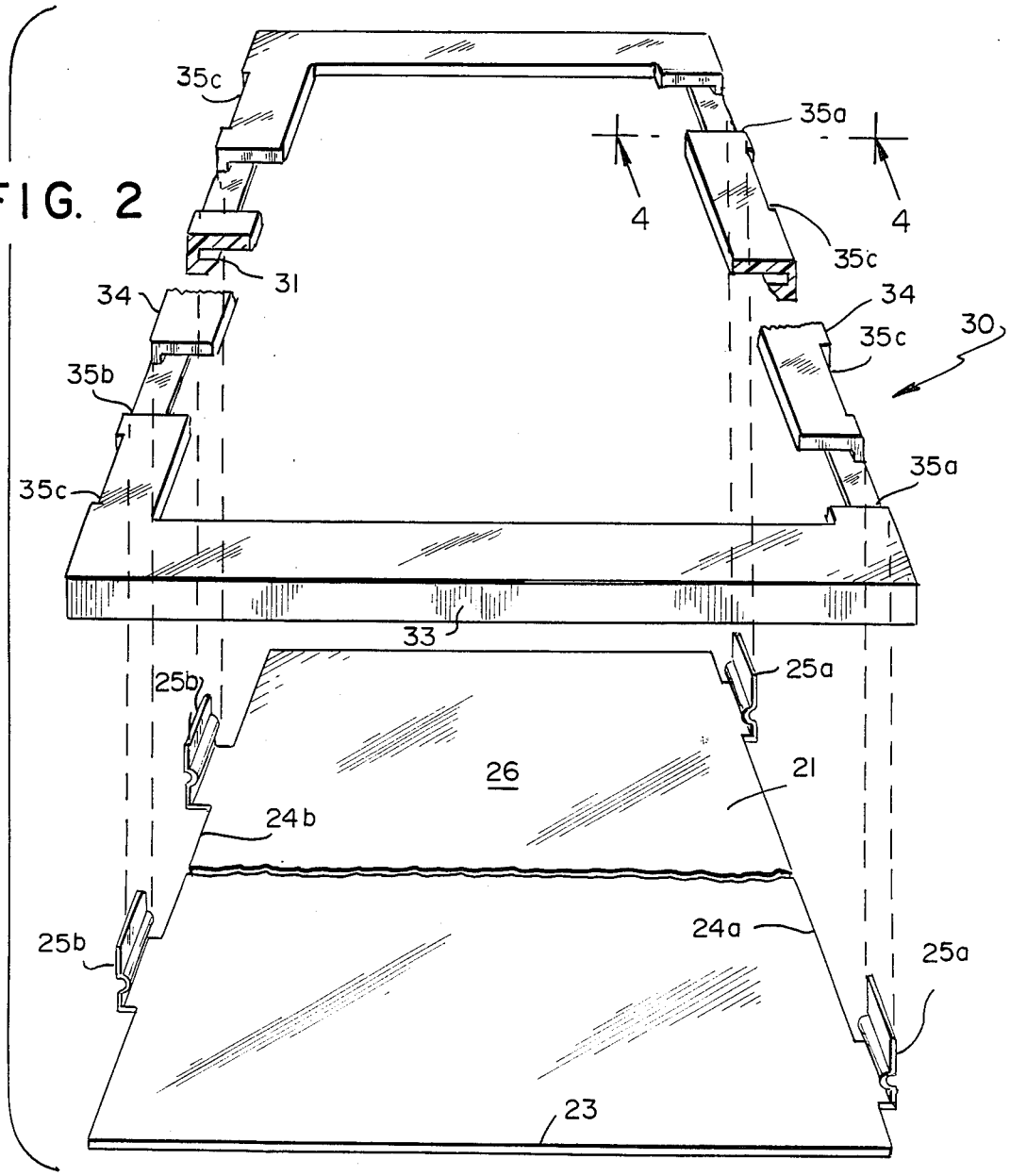
FIG. 2 is an exploded view, in perspective, of the ceiling tile and gasket of the invention before they are assembled.

FIG. 2 shows the tile 21 and gasket 30 before assembly. Tile 21 has opposed end walls 23,23 and opposed side walls, **24*a*,24*b*. Tile 21 may be made from any suitable material, such as steel or aluminum, and may be square or rectangular in shape and of any suitable size. It is presently preferred to use steel tiles 21** that are one foot square.

As seen in FIG. 2, tabs **25*a*,25*b* are offset from the outer edge of sides 24*a*, 24*b* and project away from the top face 26 of tile 21. Tabs 25*a* on side 24*a* are spaced closer to the adjacent end walls 23 than are tabs 25*b* on side 24*b***.

Gasket 30 (FIG. 2) has end portions 33 and side portions 34 forming an open frame of a size to fit around the perimeter of tile 21. In particular, gasket 30 has a slot 31 formed in portions 33,34 that has an opening in the inner walls of portions 33,34 of the gasket 30 for receiving tile 21. Gasket 30 also has spaced apart indentations or crenels **35*a*, 35*b* formed in the top walls of portions 34, which communicate with slot 31 for receiving tabs 25*a*,25*b* respectively. Formed in the outer walls of side portions 34 are recesses 35*c***, which will be described in detail hereinafter.

Gasket 30 may be formed from rubber, a thermoplastic polymer or a synthetic elastomer, such as PVC, using the same extrusion and heat welding techniques and equipment used in forming refrigerator and freezer gaskets and the like. Alternatively, the gasket 30 can be injection molded in a multi-piece mold to form slot 31, indentations or crenels **35*a*,35*b* and recesses 35*c*** at the time the gasket is formed.

Figure 3:
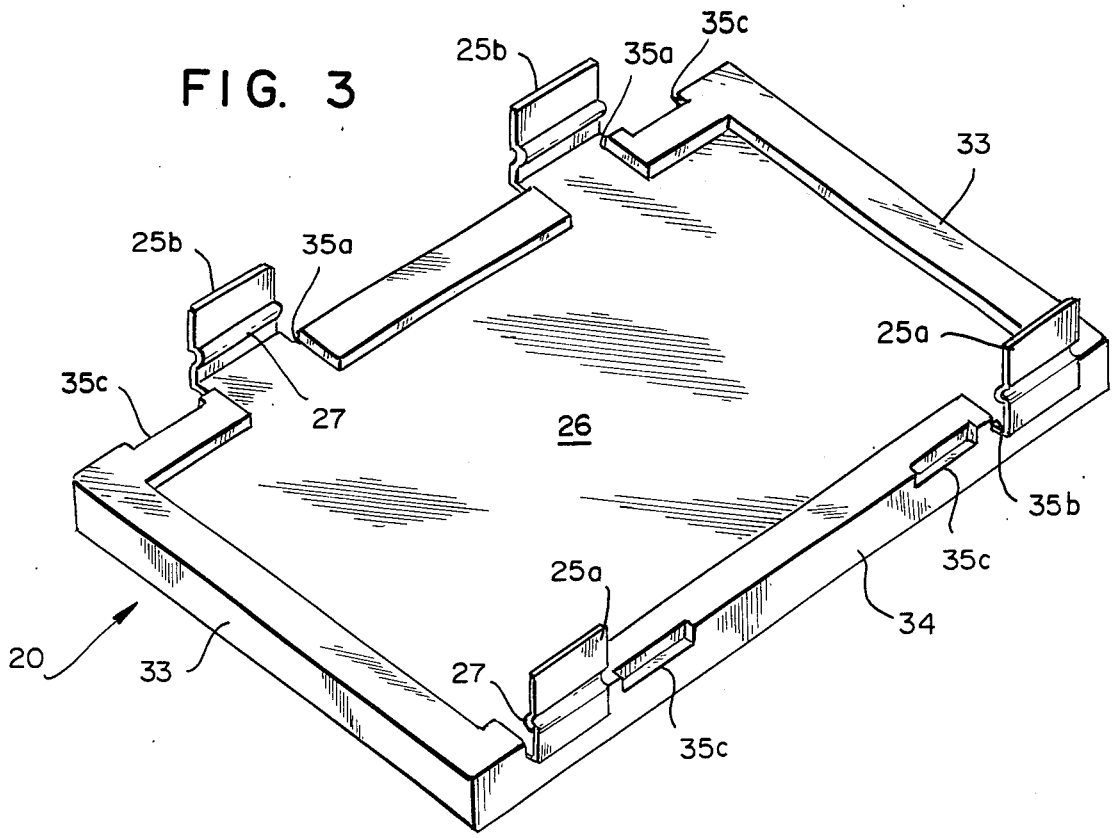
FIG. 3 is a perspective view showing the assembled ceiling tile assembly.
Figure 4:
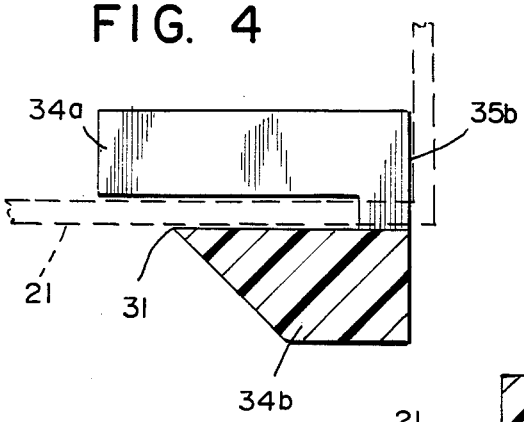
FIG. 4 is a detail view in enlarged scale, in section, taken along lines 4—4 in FIG. 2.

FIGS. 3 and 4 illustrate how the tile 21 and gasket 30 are assembled together. Side **24*a* of tile 21 may be inserted into slot 31 in wall 34 with the tabs 25*a* sliding through the corresponding indentations or gaps 35***a*, after which the gasket 30 is stretched to fit over tile 21 so that tile 21 extends into the slot 31 formed between upper portion 34*a* and lower portion 34*b* (FIG. 4) of side portion 34 while tabs 25*b* project through indentations 35*b*.

Figure 5:
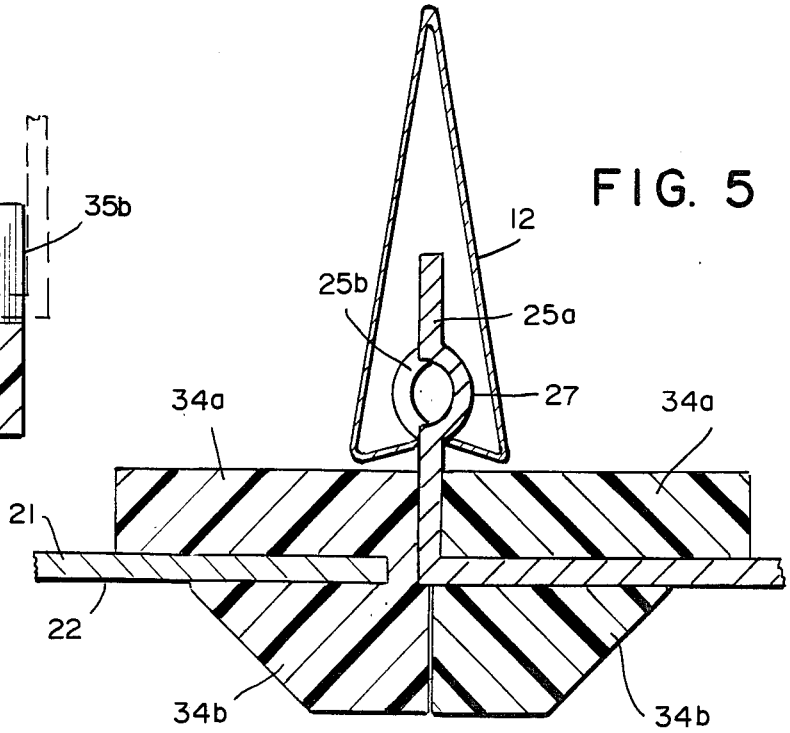
FIG. 5 is a detail view in enlarged scale, in section, taken along lines 5—5 in FIG. 1.
Figure 6:
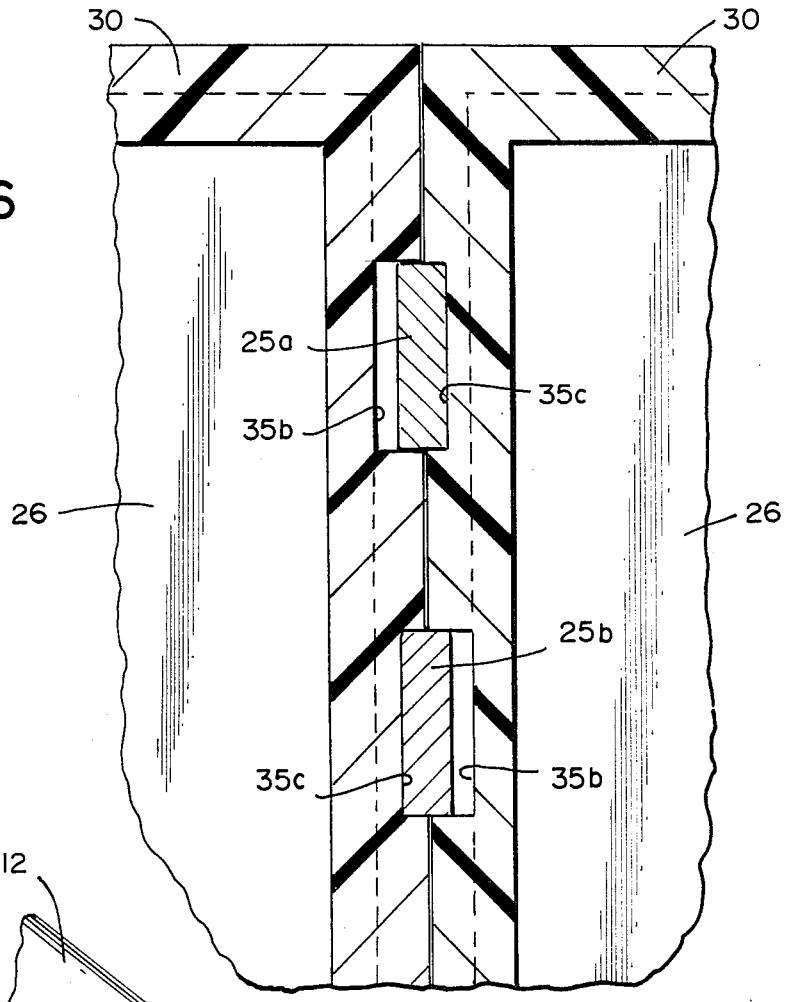
FIG. 6 is a plan view, partly in section, showing a detail of the ceiling tile and gasket.
Figure 7:
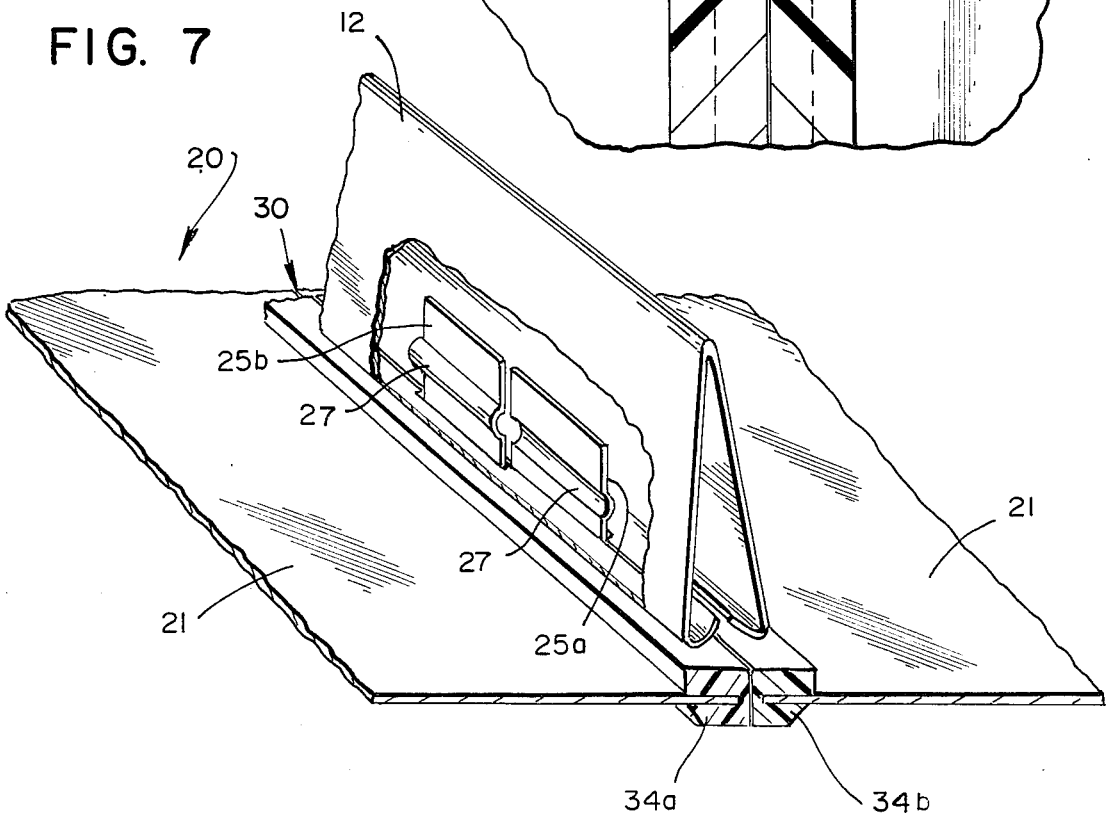
FIG. 7 is a perspective view of two adjacent ceiling tiles held in the snap bar.

FIGS. 5–7 show how ceiling tile assemblies 20 are secured in snap-bar 12. Snap-bar 12 is of conventional construction and has a pair of opposed spring-like arm extending from a common, integrally formed base portion terminating in free ends biased toward one another as shown. To secure the assemblies 20 to the snap-bar 12, the tabs 25*a* of one assembly 20 are pushed into snap-bar 12, which will open to permit entry of the curved retaining portion 27 and then close after locking portion 27 passes by the free ends of snap-bar 12, thereby holding the associated tile 21 in place and preventing it from accidental removal. Tabs 25*b* of the next adjacent tile 21 are then inserted into the snap bar 12 in the same manner.

As best seen in FIG. 6, the recesses 35*c* of one gasket 30 receive and are in contact with the outer surface of tabs 25*a*,25*b* of tiles 21 held within the next adjacent gaskets 30 to provide a moisture-proof seal between adjacent assemblies 20. Preferably, the tabs 25*a*,25*b* are offset from tile 21 as shown in FIGS. 2,3 and 6 so that they are in alignment when they are snapped into snap bar 12, whereby the snap bar 12 need only accommodate a single thickness of tab 25*a* or 25*b*. See FIGS. 5 and 6. Further, while the tabs 25*a*,25*b* of adjacent tiles 21 held in snap bar 12 are preferably spaced apart longitudinally as shown in FIG. 6, they may also be immediately adjacent one another as shown in FIG. 7. The arrangement of FIG. 6 is preferably obtained by using tabs 25*a*,25*b* about one-half inch wide, with tabs 25*a* spaced inwardly about one-half inch from ends 23 and tabs 25*b* spaced inwardly about two inches from ends 23.

The coating 22 on the underside of tile 21 may be of any vitreous material. It is presently preferred to use a porcelainized glass as the vitreous coating 22.

Figure 8:
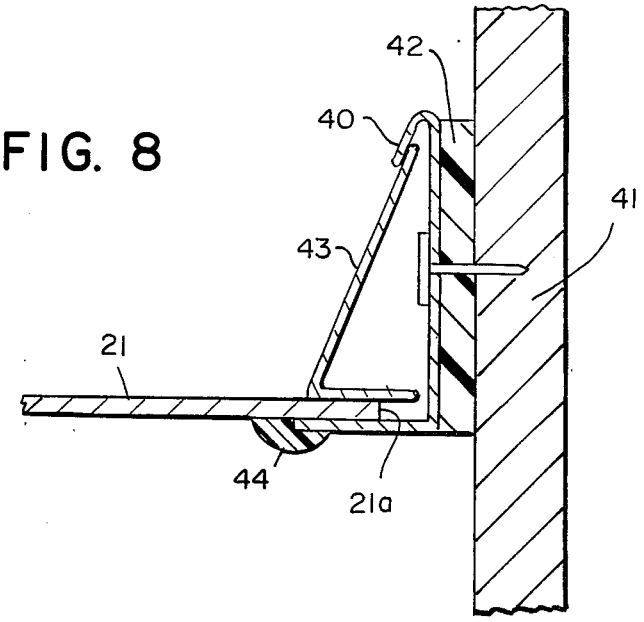
FIG. 8 is a view, in section, showing the attachment of the ceiling tile to the wall.

To construct the suspended ceiling 11, snap-bars 12 are hung in parallel by wires 13 or other hangers from ceiling 14 in a conventional manner. Tile assemblies 20 are snapped into the snap bar 12 starting from the middle of the room and proceeding to the walls. At the walls, the assemblies 20 are field cut (FIG. 8) to expose an end 21*a* of the tile 21 closely adjacent the wall 41. A bracket 40 is secured to the wall 41. To maintain the moisture- and vapor seal around the perimeter of the room, a suitable resilient gasket 42 is placed between the bracket 40 and wall 41. After placing end 21*a* on bracket 40, spring clip 43 is snapped in place as shown to hold the tile 21 in place. As shown in FIG. 8, the field cut end 21*a* is sealed by caulking 44 at its interface with bracket 40.

Figure 9:
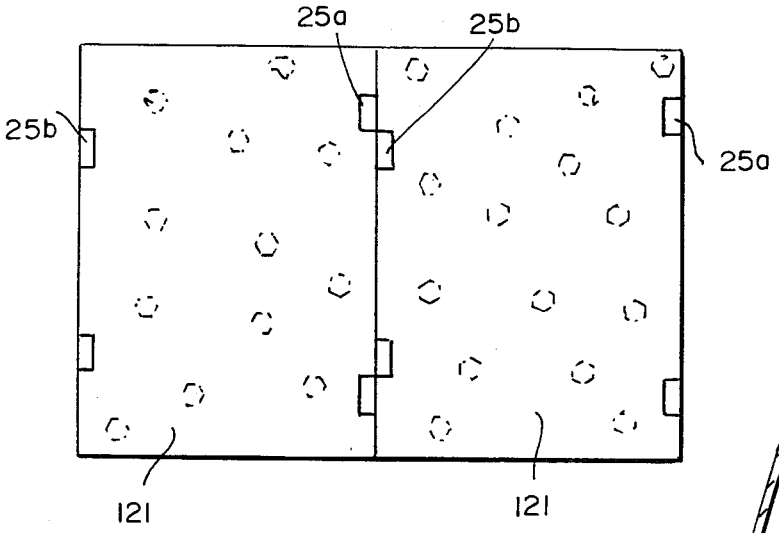
FIG. 9 is a plan view of an alternative embodiment of the invention.
Figure 10:
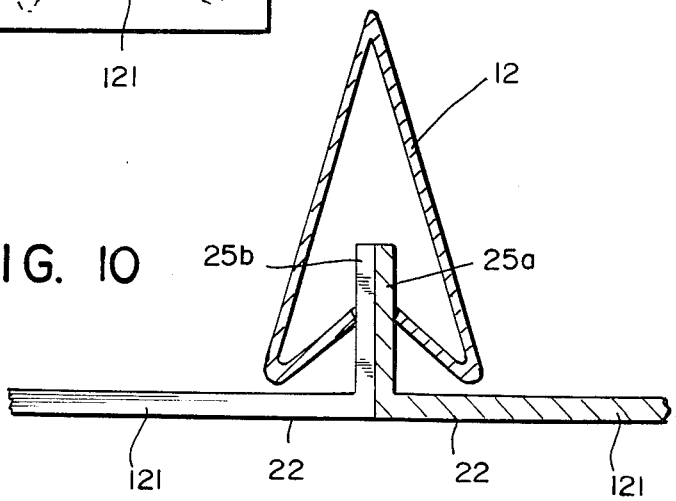
FIG. 10 is a view similar to FIG. 5 showing the ceiling tiles of FIG. 9 suspended from a snap bar.

While it is preferred to erect the ceiling 11 using gasket assemblies 20, it is also possible to omit gasket 30 and yet obtain a ceiling with tight, fine line joints, as shown in FIGS. 9 and 10. In FIGS. 9 and 10, ceiling tile 121 is otherwise identical to tile 21, except that the tabs 25*a*,25*b* project from the top surface and are aligned with the perimeter of top surface, rather than being offset beyond the perimeter as in tile 21. This enables two adjacent tiles 121 to abut one another along their sides without any gaps, thus giving use to almost invisible, fine line joints between tiles 121 in the ceiling. FIG. 10 shows the tiles 121 held within snap bar 12.

If desired, the tile 21 or 121 can be perforated, as shown by dotted line in FIG. 9, in which case sound absorbent material can be placed on the top surface. While this will provide the ceiling with sound absorbing properties, the perforations would prevent the ceiling from acting as a moisture barrier.

I claim:

1. A ceiling tile, which comprises a planar metal body having opposed sides, opposed ends, top and bottom faces and 90° corners, a pair of spaced tabs at each side projecting from said top face, and a layer of a vitreous material on said bottom face, said tabs being asymmetrical with respect to the longitudinal axis of said planar metal body and offset from their respective sides of said planar metal body.

2. The ceiling tile according to claim 1, wherein said vitreous material is glass porcelainized to said bottom surface.

3. The ceiling tile according to claim 1, wherein a resilient gasket encloses the perimeter of said planar metal body while exposing said vitreous material, said tabs projecting through and extending beyond said gasket.

4. The suspended ceiling according to claim 3, wherein said planar metal body is held within a slot formed in said gasket and said tabs project through crenels formed in said gasket.

5. The ceiling tile according to claim 1, wherein said planar metal body is perforated.

6. A suspended ceiling suspended from the structural ceiling of a room, which comprises a plurality of parallel, elongated, snap-bars, each having a pair of longitudinally extending, opposed spring-like arms biased to be closely together, and a plurality of metal ceiling tiles held by snap-bars in side-by-side relationship, each said ceiling tile having a planar metal body having opposed sides, opposed ends, top and bottom faces and 90° corners, a pair of spaced tabs at each side projecting from said top face, and a layer of a vitreous material on said bottom face, said tabs being asymmetrical with respect to the longitudinal axis of said planar metal body and offset from their respective sides of said planar metal body, the tabs of one side of one ceiling tile held within a snap-bar in alignment with the tabs of the immediately adjacent side of the next adjacent ceiling tile held within the same snap-bar.

7. The suspended ceiling according to claim 6, wherein said vitreous material is glass porcelainized to said bottom surface.

8. The suspended ceiling according to claim 6, wherein said tiles have a resilient gasket enclosing the perimeter of said planar metal body while exposing said vitreous material, said tabs projecting through and extending beyond said gasket.

9. The suspended ceiling according to claim 8, wherein said planar metal body is held within a slot formed in said gasket and said tabs project through crenels formed in said gasket.

10. The suspended ceiling according to claim 9, wherein said planar metal body is perforated.

11. A ceiling tile, which comprises a planar metal body having opposed sides, opposed ends, top and bottom faces at 90° corners, and a pair of spaced tabs at each side projecting from said top face, said tabs being asymmetrical with respect to the longitudinal axis of said planar metal body and offset from their respective sides of said planar metal body.

12. A ceiling tile, which comprises a planar metal body having opposed sides, opposed ends, top and bottom faces and 90° corners, a pair of spaced tabs offset from each side and projecting from said top face, and a layer of a vitreous material on said bottom face; and a resilient gasket enclosing the perimeter of said planar metal body while exposing said vitreous material, said planar metal body being held within a slot formed in said gasket with said tabs projecting through crenels formed in said gasket and extending beyond said gasket.

13. A suspended ceiling suspended from the structural ceiling of a room, which comprises a plurality of parallel, elongated, snap-bars, each having a pair of longitudinally extending, opposed spring-like arms biased to be closely together, and a plurality of metal ceiling tiles held by snap bars in side-by-side relationship, each said ceiling tile having a planar metal body having opposed sides, opposed ends, top and bottom faces and 90° corners, a pair of spaced tabs offset from each side and projecting from said top face, and a layer of a vitreous material on said bottom face, the tabs of one side of one ceiling tile being held within the same snap-bar as the tabs of the immediately adjacent side of the next adjacent ceiling tile; and a resilient gasket enclosing the perimeter of said planar metal body while exposing said vitreous material, said planar metal body being held within a slot formed in said gasket, and said tabs projecting through crenels formed in said gasket and extending beyond said gasket.

* * * * *